US008704444B2

(12) United States Patent
Marchandise et al.

(10) Patent No.: US 8,704,444 B2
(45) Date of Patent: Apr. 22, 2014

(54) HALL-EFFECT PLASMA THRUSTER

(75) Inventors: Frédéric Marchandise, Vernon (FR); Jean-Luc Pattyn, Gaillon (FR); Laurent Godard, Saint Marcel (FR); Dominique Indersie, Vernon (FR)

(73) Assignee: SNECMA, Paris (FR)

( * ) Notice: Subject to any disclaimer, the term of this patent is extended or adjusted under 35 U.S.C. 154(b) by 148 days.

(21) Appl. No.: 13/496,402

(22) PCT Filed: Sep. 17, 2010

(86) PCT No.: PCT/FR2010/051943

§ 371 (c)(1),
(2), (4) Date: May 1, 2012

(87) PCT Pub. No.: WO2011/033238

PCT Pub. Date: Mar. 24, 2011

(65) Prior Publication Data

US 2012/0206045 A1 Aug. 16, 2012

(30) Foreign Application Priority Data

Sep. 17, 2009 (FR) ..... 09 56397

(51) Int. Cl.
*H01J 7/24* (2006.01)

(52) U.S. Cl.
USPC ..... 315/111.41; 315/111.21; 60/202

(58) Field of Classification Search
USPC ..... 315/111.21, 111.41, 111.81, 111.91; 313/154, 161, 359.1, 361.1, 362.1; 60/202
See application file for complete search history.

(56) References Cited

U.S. PATENT DOCUMENTS

| | | | | |
|---|---|---|---|---|
| 5,475,354 | A | 12/1995 | Valentian et al. | |
| 5,646,476 | A * | 7/1997 | Aston | 313/359.1 |
| 5,763,989 | A * | 6/1998 | Kaufman | 313/361.1 |
| 6,640,535 | B2 * | 11/2003 | Gallimore et al. | 60/202 |
| 6,735,935 | B2 * | 5/2004 | Hruby et al. | 60/202 |
| 7,116,054 | B2 | 10/2006 | Zhurin | |
| 7,459,858 | B2 * | 12/2008 | Hruby et al. | 315/111.21 |
| 7,589,474 | B2 * | 9/2009 | Chu et al. | 315/111.81 |
| 2002/0008455 | A1 * | 1/2002 | Fisch et al. | 313/359.1 |
| 2005/0116652 | A1 | 6/2005 | McVey et al. | |
| 2012/0117938 | A1 * | 5/2012 | Barral et al. | 60/202 |

FOREIGN PATENT DOCUMENTS

| | | |
|---|---|---|
| RU | 2 209 532 | 7/2003 |
| WO | 95 00758 | 1/1995 |

OTHER PUBLICATIONS

International Search Report Issued Dec. 8, 2010 in PCT/FR10/51943 Filed Sep. 17, 2010.

* cited by examiner

*Primary Examiner* — Vibol Tan
(74) *Attorney, Agent, or Firm* — Oblon, Spivak, McClelland, Maier & Neustadt, L.L.P.

(57) ABSTRACT

A Hall effect plasma thruster including an annular discharge channel around a main axis presenting an open downstream end and defined between an inner wall and an outer wall, at least one cathode, a magnetic circuit for creating a magnetic field in the channel, a pipe for feeding ionizable gas to the channel, an anode, and a manifold placed in the upstream end of the channel. The manifold is connected to the pipe and enables the ionizable gas to flow into the ionization zone of the channel in concentric manner around the main axis. The anode acts as a manifold, and the manifold includes a directional mechanism that gives rise at an outlet from the manifold to swirling motion of the gas around the main axis.

19 Claims, 4 Drawing Sheets

HALL-EFFECT PLASMA THRUSTER

The present invention relates to an accelerator of the type comprising an annular discharge channel (forming a main ionizing and accelerator channel) around a main axis presenting an open downstream end and defined between an inner wall and an outer wall, at least one cathode, a magnetic circuit for creating a magnetic field in said channel, a pipe for feeding ionizable gas to the channel, an anode, and a manifold placed in the upstream end of the channel, said manifold being connected to the pipe and enabling the ionizable gas to flow into the ionization zone of the channel in concentric manner around the main axis.

This type of accelerator is also referred to as a plasma accelerator with closed electron drift or a steady plasma accelerator.

The invention relates in particular to Hall effect plasma thrusters used for electrical propulsion in space, in particular for propelling satellites such as geostationary telecommunications satellites. Because of their high specific impulse (lying in the range 1500 seconds (s) to 6000 s), they make considerable mass savings possible on satellites compared with accelerators using chemical propulsion.

A typical application for this type of accelerator corresponds to providing north/south control for geostationary satellites, where mass savings of 10% to 15% are obtained. This type of accelerator is also used for interplanetary primary propulsion, for compensating drag in low orbit, for maintaining a helio-synchronous orbit, for transferring orbits, or for de-orbiting at the end of lifetime. It may be used occasionally, possibly by combining electrical propulsion with chemical propulsion, for the purposes of avoiding collision with debris or of compensating a failure while being put onto a transfer orbit.

FIGS. 1 to 4 relate to a prior art Hall effect thruster 10. In FIG. 1, the Hall effect thruster 10 is shown diagrammatically. A central magnetic coil 12 surrounds a central core 14 that extends along the longitudinal main axis A. An annular inner wall 16 surrounds the central coil 12. This inner wall 16 is surrounded by an annular outer wall 18, the inner wall 16 and the outer wall 18 defining between them an annular discharge channel 20 that extends around the main axis A.

In the description below, the term "inner" designates a portion closer to the main axis A, while the term "outer" designates a portion farther from the main axis A. Likewise, "upstream" and "downstream" are defined relative to the normal flow direction of gas (from upstream to downstream) through the discharge channel 20.

Usually, the inner wall 16 and the outer wall 18 form portions of a single ceramic part 19, this ceramic being insulating and uniform, and in particular being based on boron nitride and silica ($BNSiO_2$). Ceramics based on boron nitride enable Hall effect thrusters to achieve performance that is high in terms of efficiency, but they nevertheless present high rates of erosion under ion bombardment, thereby limiting the lifetime of such thrusters.

The upstream end 20*a* of the discharge channel 20 (on the left in FIG. 1) is closed by an injector system 22 made up of a pipe 24 fed with the ionizable gas (generally xenon), the pipe 24 being connected via a feed hole 25 to an anode 26 that serves as a manifold for injecting gas molecules into the discharge channel 20. At the anode 26, the gas molecules go from a tubular stream coming from the pipe 24 to being injected in an annular section into the upstream end 20*a* of the discharge channel 20 forming part of the ionization zone 28.

The downstream end 20*b* of the discharge channel 20 is open (on the right in FIG. 1).

A plurality of peripheral magnetic coils 30 present an axis parallel to the main axis A and are arranged around the outer wall 18. The central magnetic coil 12 and the peripheral magnetic coils 30 serve to generate a radial magnetic field B of intensity that is at a maximum at the downstream end 20*b* of the discharge channel 20.

A hollow cathode 40 is arranged outside the peripheral coils 30, its outlet being aimed so as to eject electrons towards the main axis A and the zone that is situated downstream from the downstream end 20*b* of the discharge channel 20. A potential difference is established between the cathode 40 and the anode 26.

The electrons as ejected in this way are directed in part into the inside of the discharge channel 20. Under the influence of the electric field generated between the cathode 40 and the anode 26, some of these electrons reach the anode 26, while most of them are trapped by the intense magnetic field B in the vicinity of the downstream end 20*b* of the discharge channel 20.

These electrons come into collision with gas molecules flowing from upstream to downstream in the discharge channel 20, thereby ionizing these gas molecules.

Furthermore, these electrons that are present in the discharge channel 20 create an axial electric field E, thereby accelerating the ions between the anode 26 and the outlet (downstream end 20*b*) of the discharge channel 20, such that these ions are ejected at high speed from the discharge channel 20, thereby generating the thrust of the accelerator.

As shown in FIGS. 2 to 4, in the presence of the radial magnetic field B (field lines 42) the path followed by the ions is not parallel to the main axis A of the thruster corresponding to the thrust direction, but is subjected to angular deflection. In practice, the angle $\alpha$ formed between the jet of ions (trajectory 44 in FIGS. 2 to 4) and the main axis A is of the order of 6°.

In FIGS. 3 and 4, there can be seen the deflection of the trajectory 44 of the ions from a circle 46 centered in the discharge channel 20. This angular deflection of the trajectory of the ions tends to deform the desired laminar movement into movement that is slightly swirling, centered about the main axis A.

This deflection is partially responsible for the divergence observed between present-day Hall effect plasma thrusters.

The deflection of the gas ionized by the radial magnetic field B gives rise to mechanical torque that interferes with the search for obtaining optimized thrust from the thruster.

The object of the present invention is to provide a Hall effect plasma thruster making it possible to overcome the drawbacks of the prior art and in particular making it possible to control the angular deflection created on the ions by the radial magnetic field at the outlet from the discharge channel 20 by modifying that deflection.

More precisely, an object of the present invention is to compensate this deflection in full or in part, or even to accentuate it. Thus, for example, total compensation of the deflection makes it possible to cancel the radial component of the movement of the ions at the outlet from the discharge channel.

To this end, according to the present invention, the Hall effect plasma thruster is characterized in that the anode acts as a manifold, and in that the manifold includes directional means that give rise at the outlet from the manifold to swirling motion of the gas around the main axis.

In this way, it can be understood that because of the presence of these directional means, the swirling motion of the gas molecules as generated on leaving the manifold is capable of compensating the angular deflection of the trajectory of the ions as generated by the radial magnetic field at the downstream end of the discharge channel.

In general terms, in the invention, swirling motion is created at the upstream end of the discharge channel, which motion is superposed on the motion generated by the radial magnetic field at the downstream end of the discharge channel.

This superposition of two swirling motions makes it possible to vary and to control the deflection to which the ions are subjected by the radial magnetic field present at the downstream end of the discharge channel, with said deflection being accentuated, decreased, or totally compensated.

Overall, by means of the solution of the present invention, the mechanical torque generated by the angular speed of the inert gas by the presence of the directional means makes it possible to take account of the deflection to which the ions are subjected by the radial magnetic field present at the downstream end of the discharge channel.

In a preferred arrangement, the directional means comprise a series of exhaust orifices opening out at the outlet from the anode in the proximity of the ionization zone of the channel and forming a first non-zero angle β relative to the radial direction in projection onto a plane extending transversely to said main axis so as to orient the flow of gas in said swirling motion.

It can be understood that by means of the non-zero angle formed at the outlets from the exhaust orifices, each jet of gas leaving the manifold presents a trajectory with a tangential component that is orthogonal to the radial direction, whereby the set of gas jets leaving the anode creates mechanical torque suitable for being added to or for opposing the mechanical torque generated at the downstream end of the discharge channel by the ions being subjected to the angular deflection that is induced by the radial magnetic field.

Preferably, the first angle β formed between the radial direction and the projection onto a plane extending transversely to said main axis at the outlets from the exhaust orifices lies in the range 20° to 70°, advantageously in the range 35° to 55°, and in particular is equal to 45°.

Other advantages and characteristics of the invention appear on reading the following description made by way of example and with reference to the accompanying drawings, in which:

FIG. 1, described above, is a diagrammatic section view of a prior art Hall effect plasma thruster;

FIG. 2, described above, shows a detail II of FIG. 1;

FIG. 3, described above, is a view in perspective and in longitudinal section of the discharge channel, showing the angular deflection of the trajectory of the gas in a prior art plasma thruster;

Figure 1:
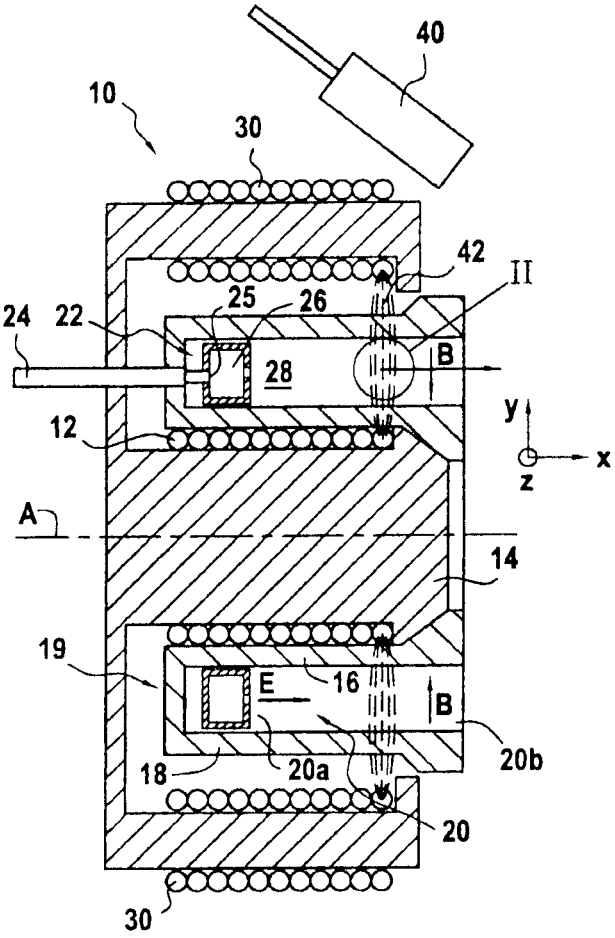
FIG.1 PRIOR ART

A preferred embodiment is described below with reference to FIGS. 5 to 11.

The anode 50 of the invention also constitutes the manifold, and for this purpose it co-operates with the inner wall 16 and the outer wall 18 of the ceramic part 19 to define from downstream to upstream an annular discharge chamber 52 that opens out into the ionization zone 28 of the channel 20 and an annular intermediate chamber 54 having at least one segment that is arranged concentrically relative to the discharge chamber 52. Exhaust orifices 53 connect said intermediate chamber 54 to said discharge chamber 52.

These exhaust orifices 53 are preferably rectilinear.

By means of the first non-zero angle β that is formed between the radial direction and the transverse projection of these exhaust orifices 53 (see FIG. 9), swirling movement is generated at the outlet from the anode.

Preferably, the manifold-forming anode 50 includes at least four exhaust orifices 53 that are angularly distributed in regular manner around the main axis A.

Figure 9:
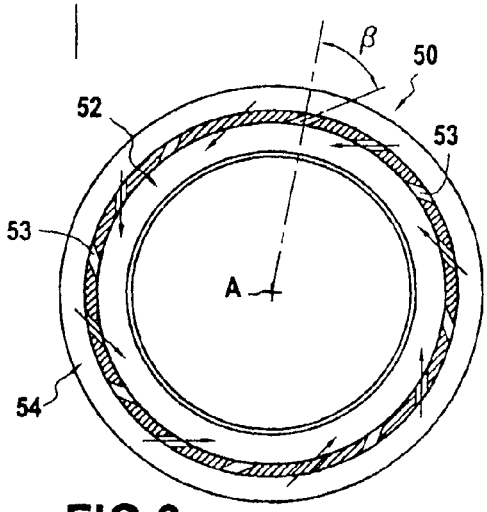

In the embodiment shown, sixteen exhaust orifices 53 are used that are regularly distributed about the main axis A with circular symmetry (see FIG. 9). This injection of gas at the outlet from the anode in a direction that is not purely radial generates mechanical torque that is additional to or that compensates (as shown in FIG. 9) the mechanical torque generated at the downstream end of the discharge channel by the ions that have been subjected to the angular deflection induced by the radial magnetic field B.

The exhaust orifices 53 of the embodiment shown (see FIGS. 7 and 9) are rectilinear and parallel to a transverse plane that is orthogonal to the main axis A, forming in said transverse plane a first angle β of 45° relative to the radial direction. Naturally, other variants are possible, whether concerning the value of the first angle β (in the range 0° to 90°, or concerning any angle of inclination relative to a transverse plane (in some configurations, the injection plane is not orthogonal to the main or thrust axis A).

At the outlet from the exhaust orifices 53, the flow of gas in the discharge chamber 52 situated immediately upstream from the ionization zone 28 normally occurs as free molecular flow.

The manifold-forming anode 50 also co-operates with the inner and outer walls 16 and 18 of the ceramic part 19 to define an annular distribution chamber 56 upstream from the intermediate chamber 54 (see FIGS. 5, 6, and 7), which distribution chamber is connected firstly to the pipe 24 and secondly to the intermediate chamber 54 via a series of flow orifices 55.

Figure 7:
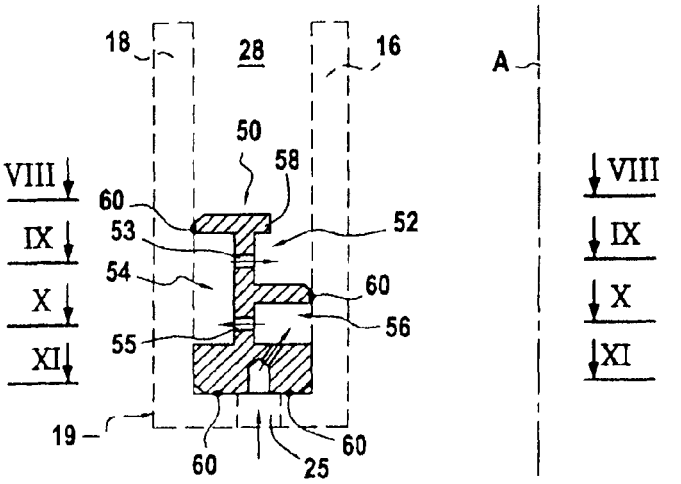
FIG. 7 is an enlarged view of the radial section of the FIG. 4 anode.
Figure 8:
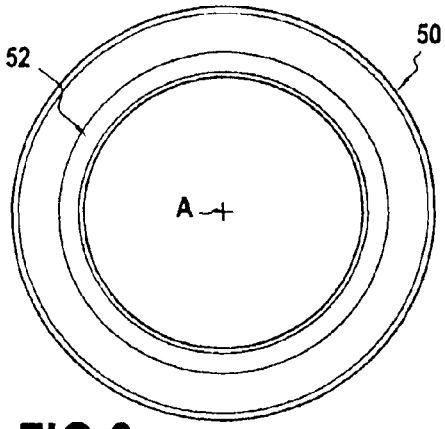
FIGS. 8 to 11 show the FIG. 7 anode, in cross-section, respectively looking in directions VIII-VIII, IX-IX, X-X, and XI-XI in FIG. 7.
Figure 10:
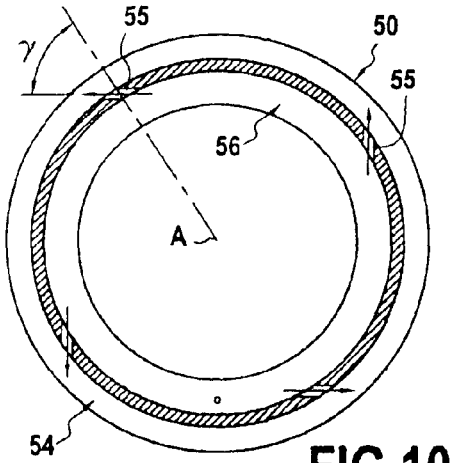
Figure 11:
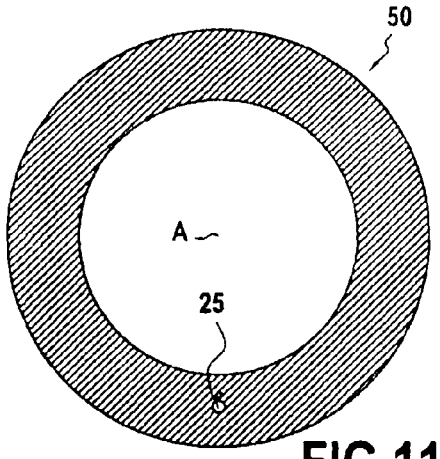

As can be seen in FIGS. 7 and 10, at their outlets, and in projection onto a plane extending transversely to said main axis A, the flow orifices 55 form a second non-zero angle γ with the radial direction so as to direct the flow of gas with a swirling motion.

Preferably, the second angle γ formed between the projection onto a plane extending transverse to said main axis A of the outlets of the flow orifices 55 and the radial direction lies in the range 20° to 70°, advantageously in the range 35° to 55°, and in particular is equal to 45°.

Preferably, this second angle γ is oriented in the opposite direction to the first angle β relative to the radial direction (in FIGS. 7, 9, and 10, the first angle β is +45° while the second angle γ is −45°).

These flow orifices 55 are preferably rectilinear.

By means of the second non-zero angle γ formed between the radial direction and the transverse projection of these flow orifices 55 (see FIG. 10), a swirling flow is generated in the intermediate chamber 54 that encourages molecular flow in the exhaust orifices 53 towards the discharge chamber 52 and the outlet from the anode 50.

Preferably, the manifold-forming anode 50 includes at least two flow orifices 55 that are angularly distributed in regular manner around the main axis A.

In the embodiment shown, four flow orifices 55 are used that are distributed in regular manner around the main axis A in circular symmetry (see FIG. 10).

The flow orifices 55 of the embodiment shown (see FIGS. 7 and 10) are rectilinear and parallel to a transverse plane, forming a second angle γ relative to the radial direction in this transverse plane, which second angle γ is equal to 45°. Naturally, other variants are possible, whether concerning the value of the second angle γ (lying in the range 0° to 90° or concerning any angle of inclination of the flow orifices 55 relative to a transverse plane.

Figure 12:
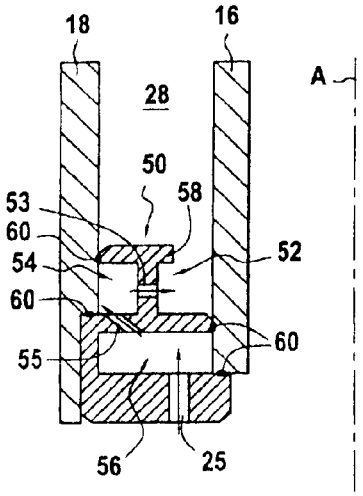
FIG. 12 is a view analogous to the view of FIG. 7 for a first variant embodiment of the anode.

In the embodiment of FIGS. 5 to 11, and in the first variant of FIG. 12, the exhaust orifices 53 are oriented in such a manner as to enable the ionizable gas to escape going towards the inner wall 16 (see FIG. 9).

Figure 2:
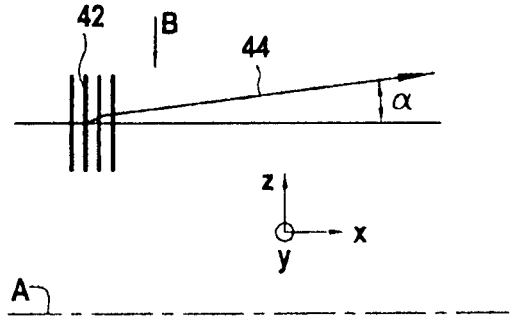
FIG.2 PRIOR ART
Figure 3:
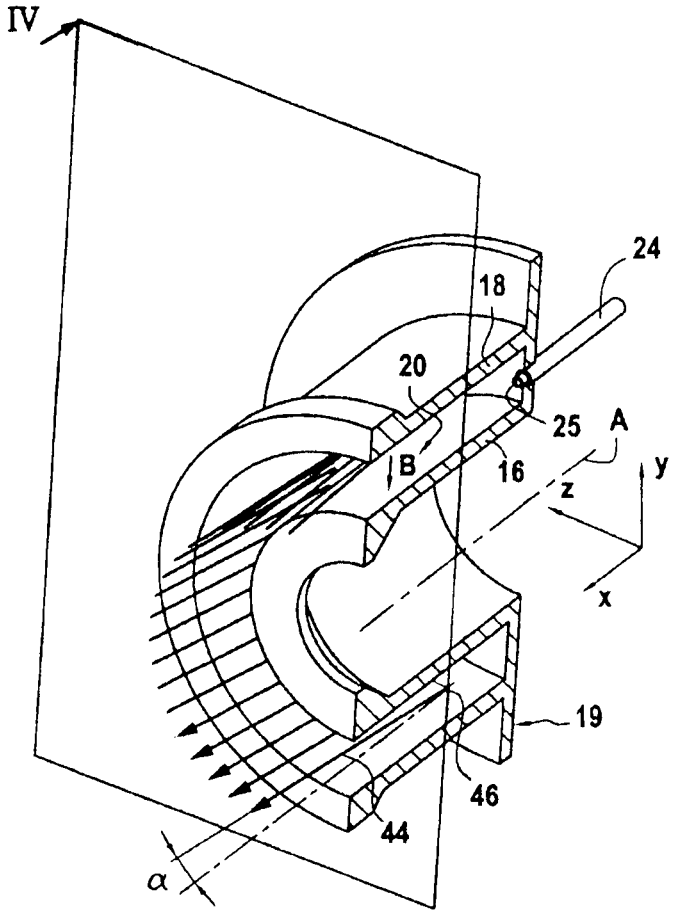
FIG.3 PRIOR ART
Figure 4:
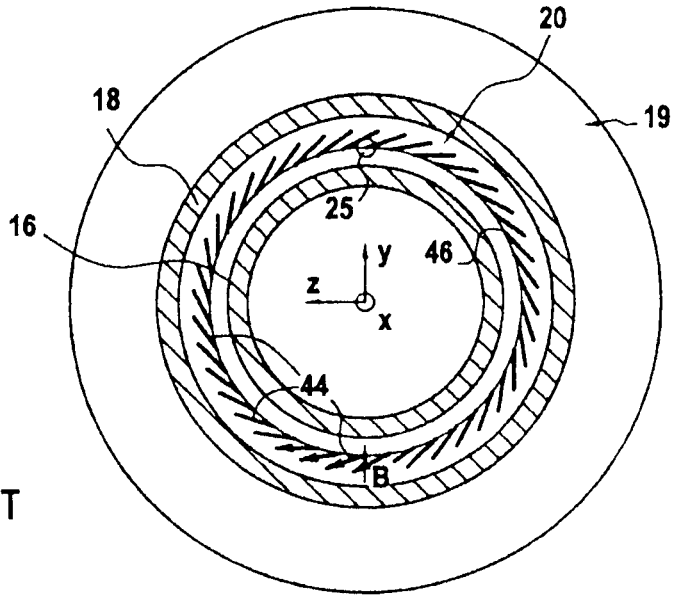
FIG.4 PRIOR ART
FIG. 4 is a section view looking in direction IV in FIG. 3.
Figure 6:
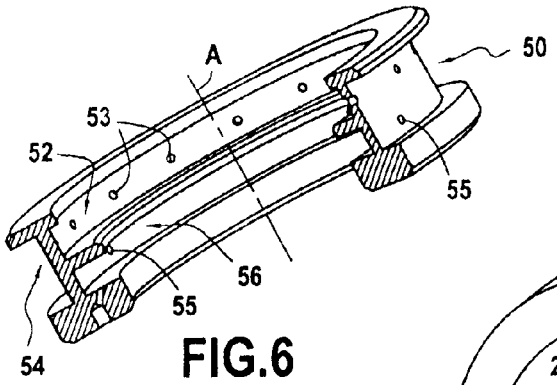
FIG. 6 is a view in perspective and in cross-section of the anode of the Hall effect plasma thruster of the invention.
Figure 5:
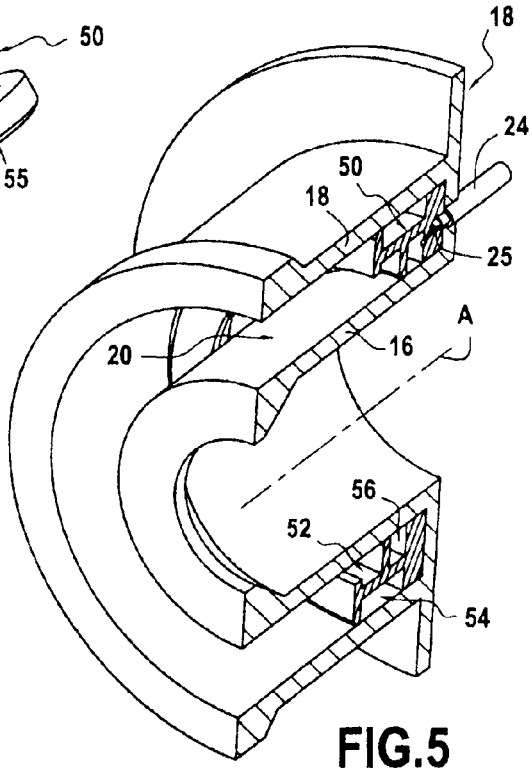
FIG. 5 is a view in perspective and in longitudinal section of the discharge channel of a Hall effect plasma thruster of the invention.

Such a configuration makes it possible to compensate, in full or in part, the angular deflection of the ions due to the radial magnetic field B as can be seen in FIGS. 2 to 4. If the orientation of the radial magnetic field B is opposite to that shown in FIGS. 1 to 4, then the situation would be modified and the angular deflection of these ions due to the magnetic field would be accentuated.

Under such circumstances, the impacts against the outer wall 18 of the molecules or ions of gas at the outlet from the anode would also present sufficient specularity for the gas coming into the ionization zone 28 to present significant residual swirling speed of the same order as that provided by the temperature difference between the inner and outer walls 16 and 18 made of ceramic.

It should be recalled that the impacts of electrons, of ions, and of molecules against the inner wall 16 and against the outer wall 18 heat these walls 16 and 18, which are also heated by the radiation from the plasma, and that given the smaller area of the inner wall 16, it presents a temperature that is higher than the temperature of the outer wall 18 (temperature difference of more than 100° C., of the order of 160° C.)

Consequently, in the invention, the above-mentioned residual swirling speed may either be added to or else subtracted from the swirling speed due to the temperature difference between the inner wall 16 and the outer wall 18. Naturally, this physical effect resulting from the temperature difference represents a phenomena of second order compared with the main phenomenon relating to compensating the circumferential deflection of the ions and the molecules by the magnetic field.

Consequently, in the embodiment of FIGS. 5 to 11, the thruster 10 includes, in the upstream portion of the discharge channel 20, going from upstream to downstream: an annular distribution chamber 56 connected to the pipe 24 and defined between the manifold-forming anode 50 and the inner wall 16; an annular intermediate chamber 54 defined between the manifold-forming anode 50 and the outer wall 18; and an annular discharge chamber 52 defined between the manifold-forming anode 50 and the inner wall 18 and opening out into the ionization zone 28 of the channel 20. Furthermore, said discharge chamber 52 and the distribution chamber 56 are superposed, and the intermediate chamber 54 surrounds the distribution chamber 56 and the discharge chamber 52. Also, a series of flow orifices 55 connect the distribution chamber 56 to the intermediate chamber 54, and a series of flow orifices 53 connect said intermediate chamber 54 to said discharge chamber 52 so as to form a first non-zero angle β relative to the radial direction in projection onto a plane extending transversely to said main axis A so as to direct the flow of gas in said swirling motion.

Thus, the distribution chamber 56 and the discharge chamber 52 form inner chambers and the intermediate chamber 54 constitutes an outer chamber.

When it is stated that two chambers are "superposed", that means that they are in upstream and downstream positions along the main axis A.

It should be observed that the distribution chamber 56 is fed with only one orifice (feed hole 25), so pressures and speeds therein are not uniform. Thus, by means of its volume and because it is fed via a plurality of flow orifices 55 (four flow orifices 55 in the embodiment shown), the intermediate chamber 54 has pressure and circumferential speed of the gas distributed more uniformly, thereby acting as a calming chamber.

In the first variant of FIG. 12, the anode 50 is of a modified shape. In this figure, the thruster 10 has, in the upstream portion of the discharge channel 20, going upstream to downstream: an annular distribution chamber 56 connected to the pipe 24 and defined between the manifold-forming anode 50 and the inner wall 16; an annular intermediate chamber 54 defined between the manifold-forming anode 50 and the outer wall 18; and an annular discharge chamber 52 defined between the manifold-forming anode 50 and the inner wall 16 and opening out into the ionization zone 28 of the channel 20. Furthermore, the intermediate chamber 54 surrounds the discharge chamber 52, said discharge chamber 52 and the distribution chamber 56 are superposed, and said intermediate chamber 54 and the distribution chamber 56 are superposed. Furthermore, a series of flow orifices 55 connect the distribution chamber 56 to the intermediate chamber 54, and a series of exhaust orifices 53 connect said intermediate chamber 54 to said discharge chamber 52 forming a first non-zero angle β relative to the radial direction in projection onto a plane extending transversely to said main axis A so as to orient the flow of gas in said swirling motion.

In this first variant of FIG. 12, the discharge chamber 52 and the distribution chamber 56 are superposed.

Thus, the discharge chamber 52 is an inner chamber and the intermediate chamber 54 constitutes an outer chamber, while the distribution chamber 56 forms a chamber extending over substantially the entire section of the discharge channel 20.

Figure 13:
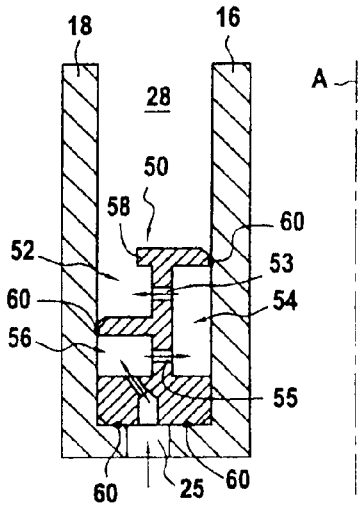
FIG. 13 is a view analogous to the view of FIG. 7, for a second variant embodiment of the anode.

In the second variant of FIG. 13, the anode 50 presents another modified shape. In this figure, the thruster 10 has, in the upstream portion of the discharge channel 20, from upstream to downstream: an annular distribution chamber 56 connected to the pipe 24 and defined between the manifold-forming anode 50 and the outer wall 18; an annular intermediate chamber 54 defined between the manifold-forming anode 50 and the inner wall 16; and an annular discharge chamber 52 defined between the manifold-forming anode 50 and the outer wall 18 and opening out into the ionization zone 28 of the channel 20. Furthermore, said distribution chamber 56 and the discharge chamber 52 are superposed, and the intermediate chamber 54 surrounds the distribution chamber 56 and the discharge chamber 52. Likewise, a series of flow orifices 55 connect the distribution chamber 56 to the intermediate chamber 54 and a series of exhaust orifices 53 connect said intermediate chamber 54 to said discharge chamber 52, forming a first non-zero angle β relative to the radial direction in projection onto a plane extending transversely to said main axis A, so as to orient the flow of gas in said swirling motion.

Thus, the distribution chamber 56 and the discharge chamber 52 form inner chambers and the intermediate chamber 54 constitutes an outer chamber.

It should be observed that in the second variant of FIG. 13, the exhaust orifices 53 enable the ionizable gas to be delivered towards the outer wall 18 with swirling motion.

When the radial magnetic field B is oriented as shown in FIGS. 2 to 4, this configuration then makes it possible to accentuate the angular deflection of the ions due to the radial magnetic field. If the orientation of the radial magnetic field B is opposite that of FIGS. 1 to 4, then the situation is modified and there would be (total or partial) compensation of the angular deflection of the ions due to the magnetic field.

Under all circumstances, provision is made for a wall of the anode 50 to extend radially above the outlets from the exhaust orifices 53 so as to form a protective wall 58 that prevents or at least limits ions and/or electrons being present in the proximity of the outlets from the exhaust orifices 53. In this way, the exhaust orifices 53 are protected from becoming clogged by eroded material (ceramic) coming from the inner wall 16 and the outer wall 18.

The anode 50 and the manifold preferably coincide. These two functions are then performed by a single part or group of parts.

The anode 50 is preferably a single piece and is made essentially out of carbon, thereby making it easier to mount in the bottom of the discharge channel 20. It is also possible to make the anode 50 as a plurality of parts that are assembled together.

Furthermore, and preferably, the inner wall 16 and the outer wall 18 are made of ceramic and are connected in leaktight manner with the anode 50.

By way of example, the ceramic part 19 may be made out of boron nitride and silica ($BNSiO_2$).

Thus, by using materials to make the anode 50 and the ceramic part 19 that present coefficients of thermal expansion that are close, it is ensured that a leaktight connection is maintained between the anode 50 and the inner and outer walls 16 and 18, with this taking place via the chambers 52, 54, and 56.

Thus, four annular fastening zones 60 are made between the anode 50 and the inner and outer walls 16 and 18, e.g. by brazing (see FIGS. 7, 12, and 13).

In the examples illustrating the prior art and the present invention, the anode and the manifold are shown as forming a single part (reference 26 in FIGS. 1 to 4 and 50 in FIGS. 5 to 13): nevertheless, it should be observed that it is possible to separate the two functions by using two parts or two sets of parts that are independent, without thereby going beyond the ambit of the present invention. Under such circumstances, the anode and the manifold should be placed at the bottom of the discharge channel, with the manifold being connected to the gas feed pipe and the anode being connected to an electricity source.

The invention claimed is:

1. A Hall effect plasma thruster comprising:

an annular discharge channel around a main axis presenting an open downstream end and defined between an inner wall and an outer wall;

at least one cathode;

a magnetic circuit for creating a magnetic field in the channel;

a pipe for feeding ionizable gas to the channel;

an anode; and a manifold placed in an upstream end of the channel, the manifold being connected to the pipe and enabling the ionizable gas to flow into the ionization zone of the channel in concentric manner around the main axis, wherein the anode acts as a manifold, and the manifold includes directional means that give rise at the outlet from the manifold to swirling motion of the gas around the main axis.

2. A Hall effect plasma thruster according to claim 1, wherein the directional means comprises a series of exhaust orifices opening out at the outlet from the anode in proximity of the ionization zone of the channel and forming a first non-zero angle relative to the radial direction in projection onto a plane extending transversely to the main axis so as to orient the flow of gas in the swirling motion.

3. A Hall effect plasma thruster according to claim 2, wherein the manifold co-operates with the inner wall and the outer wall to define, going from downstream to upstream: an annular discharge chamber opening out into the ionization zone of the channel; and an annular intermediate chamber having at least one segment located concentrically relative to the discharge chamber; and wherein the exhaust orifices connect the intermediate chamber to the discharge chamber.

4. A Hall effect plasma thruster according to claim 3, wherein the manifold co-operates with the inner and outer walls also to define, upstream from the intermediate chamber, an annular distribution chamber connected firstly to the pipe and secondly to the intermediate chamber via a series of flow orifices.

5. A Hall effect plasma thruster according to claim 4, wherein the flow orifices form a second non-zero angle relative to the radial direction in projection onto a plane transverse to the main axis so as to orient the flow of gas in a swirling motion.

6. A Hall effect plasma thruster according to claim 2, wherein the first angle lies in a range of 20° to 70°.

7. A Hall effect plasma thruster according to claim 6, wherein the first angle lies in a range of 35° to 55°.

8. A Hall effect plasma thruster according to claim 6, wherein the first angle is substantially equal to 45°.

9. A Hall effect plasma thruster according to claim 2, wherein the exhaust orifices allow the ionizable gas to be discharged towards the inner wall.

10. A Hall effect plasma thruster according to claim 2, wherein the exhaust orifices allow the ionizable gas to be discharged towards the outer wall.

11. A Hall effect plasma thruster according to claim 2, wherein the manifold includes at least four exhaust orifices angularly distributed in regular manner around the main axis.

12. A Hall effect plasma thruster according to claim 1, further comprising, in the upstream portion of the discharge channel from upstream to downstream:

an annular distribution chamber connected to the pipe and defined between the manifold and the inner wall;

an annular intermediate chamber defined between the manifold and the outer wall; and an annular discharge chamber defined between the manifold and the inner wall and opening out into the ionization zone of the channel, wherein the discharge chamber and the distribution chamber are superposed, wherein the intermediate chamber surrounds the distribution chamber and the discharge chamber, wherein a series of flow orifices connect the distribution chamber to the intermediate chamber, and wherein a series of exhaust orifices connect the intermediate chamber to the discharge chamber forming a first non-zero angle relative to the radial direction in projection onto a plane extending transversely to the first axis so as to orient the flow of gas in the swirling motion.

13. A Hall effect plasma thruster according to claim 1, further comprising in the upstream portion of the discharge channel, from upstream to downstream:

an annular distribution chamber connected to the pipe and defined between the manifold and the inner wall;

an annular intermediate chamber defined between the manifold and the outer wall; and an annular discharge chamber defined between the manifold and the inner wall and opening out into the ionization zone of the channel, wherein the intermediate chamber surrounds the discharge chamber, wherein the discharge chamber and the distribution chamber are superposed, wherein the intermediate chamber and the distribution chamber are superposed, wherein a series of flow orifices connect the distribution chamber to the intermediate chamber, and wherein a series of exhaust orifices connect the intermediate chamber to the discharge chamber forming a first non-zero angle relative to the radial direction in projection onto a plane extending transversely to said main axis so as to orient the gas flow in said swirling motion.

14. A Hall effect plasma thruster according to claim 1, further comprising, in the upstream portion of the discharge channel, from upstream to downstream:

an annular distribution chamber connected to the pipe and defined between the manifold and the outer wall;

an annular intermediate chamber defined between the manifold and the inner wall; and an annular discharge chamber defined between the manifold and the outer wall and opening out into the ionization zone of the channel, wherein the distribution chamber and the discharge chamber are superposed, wherein the intermediate chamber surrounds the distribution chamber and the discharge chamber, wherein a series of flow orifices connect the distribution chamber to the intermediate chamber, and wherein a series of exhaust orifices connect the intermediate chamber to the discharge chamber forming a first non-zero angle relative to the radial direction in projection onto a plane extending transversely to the main axis so as to orient the flow of gas in the swirling motion.

15. A Hall effect plasma thruster according to claim 1, wherein the anode and the manifold coincide.

16. A Hall effect plasma thruster according to claim 15, wherein the anode is a single piece made essentially of carbon, and wherein the inner wall and the outer wall are made of ceramic and are connected in leaktight manner to the anode.

17. A Hall effect plasma thruster according to claim 5, wherein the second angle lies in a range of 20° to 70°.

18. A Hall effect plasma thruster according to claim 5, wherein the second angle lies in a range of 35° to 55°.

19. A Hall effect plasma thruster according to claim 5, wherein the second angle is substantially equal to 45°.

* * * * *